US006298861B1

(12) United States Patent
Kageyama et al.

(10) Patent No.: US 6,298,861 B1
(45) Date of Patent: Oct. 9, 2001

(54) WIG STOPPER AND WIG STOPPER FITTING SHEET

(75) Inventors: Masanori Kageyama; Masataka Itoh, both of Niigata-ken (JP)

(73) Assignee: Aderans Co., Ltd., Tokyo (JP)

( * ) Notice: Subject to any disclaimer, the term of this patent is extended or adjusted under 35 U.S.C. 154(b) by 0 days.

(21) Appl. No.: 09/242,740

(22) PCT Filed: Jun. 3, 1998

(86) PCT No.: PCT/JP98/02457

§ 371 Date: Oct. 19, 1999

§ 102(e) Date: Oct. 19, 1999

(87) PCT Pub. No.: WO98/54993

PCT Pub. Date: Dec. 10, 1998

(30) Foreign Application Priority Data

Jun. 5, 1997 (JP) ..... 9-162036

(51) Int. Cl.[7] ..... A41G 3/00; A41G 5/00

(52) U.S. Cl. ..... 132/53; 132/55; 132/56; 132/201

(58) Field of Search ..... 132/53, 55, 56, 132/201, 278, 275, 280, 283, 284

(56) References Cited

U.S. PATENT DOCUMENTS

D. 284,318 * 6/1986 Nemoto ..... D28/9
D. 286,687 * 11/1986 Nemoto ..... D28/9
3,980,092 * 9/1976 Garufi ..... 132/53
4,155,370 * 5/1979 Nemoto ..... 132/53
4,625,739 * 12/1986 Hamazaki ..... 132/54
5,005,594 * 4/1991 Dunagan ..... 132/53
5,137,037 * 8/1992 Mochizuki ..... 132/53
5,303,724 * 4/1994 Anzivino ..... 132/278

FOREIGN PATENT DOCUMENTS

2504129 * 8/1976 (DE) ..... 132/53
3039038 * 5/1982 (DE) ..... 132/53

* cited by examiner

*Primary Examiner*—Nicholas D. Lucchesi
*Assistant Examiner*—Robyn Kieu Doan
(74) *Attorney, Agent, or Firm*—Wenderoth, Lind & Ponack, L.L.P.

(57) ABSTRACT

A wig stopper including a bent, counter-bendable, component that is obtained by processing a single elastic thin sheet to bend and impart a counter-bendable characteristic thereto. The wig stopper further includes a number of hair-fastening components, each having a base end part provided on the longitudinal side of the upper end of the bent, counter-bendable, component. Also, a tip end part is extended to the longitudinal side of the lower end of the bent, counter-bendable, component such that the hair-fastening components are arranged in a comb-tooth fashion.

12 Claims, 8 Drawing Sheets

WIG STOPPER AND WIG STOPPER FITTING SHEET

FIELD OF THE INVENTION

The present invention relates to a wig stopper for fitting a wig to the head of a wearer and a wig stopper-fitting sheet for fixing the wig stopper to the back of the wig base.

DESCRIPTION OF THE PRIOR ART

A conventional wig stopper having a structure that enables fitting a wig to the hair (natural hair) of a wig-wearing person, includes comb-tooth hair-fastening components (hereafter may be referred to as a stopper) that need to be bent to prevent both ends thereof from coming to the surface of the wig when it is fitted to the head. Further, for the purpose of facilitating wearing and removal of the hair-fastening components, extrusion pressure on an elastic sheet that constitutes the stopper prevents counter-bendable of the wig stopper, and hence the wig (official gazette of Japanese Utility Model Application No. 56-23294).

A conventional stopper (a) as shown in FIG. 8 is manufactured, in order to impart a bent configuration and to prevent counter-bendable, by a method comprising blanking an elastic metal thin sheet into a U-shape, forcibly fixing the open ends with a circular metal fitting, an eyelet (b), to make an O-shape and bending it into a bow-like form.

However, the stopper (a) obtained according to such a method, is uncomfortable since two metal sheets are joined in a piled state at the spot of the eyelet (b).

Moreover, the following problems may occur when fitting a conventional wig stopper to the back of a wig base. When the stopper is adhered and fitted by means of a plastic sheet-like stopper-fitting component (c), eyelets (b) and (d) (b is used also for joining the above metal sheets together), used for fitting the metal sheets to component (c), considerably increases the thickness, which decreases comfort. On the other hand, when the stopper (a) is fabricated so as to be sewn onto a wig base, a process of providing sewing holes on the stopper is required. Further if the stopper (a) is fabricated so as to be sewn onto a wig base, the wig base itself may be damaged.

Further, the hair of a wig-wearing person may tangle with the eyelets (b) and (d) and washers (b1) and (d1), which may cause pain to the wig-wearing person while wearing and removing a wig having such a stopper.

In addition, a tubular frictional component f is provided on the leg piece (a1) of the stopper, pressure from comb teeth (e) prevent the stopper from coming off from the held hair. However, the thickness of such a frictional component has become one factor in deteriorating comfort.

The present invention provides solutions to the above problems. It is an object of the present invention to provide a thin stopper with no eyelet. It is another object thereof to provide a stopper-fitting component in which a conventional stopper-fitting component and a frictional component are integrated for the purpose of decreasing overall thickness while at the same time, improving comfort while wearing and facilitating removal from a wig base.

SUMMARY OF THE INVENTION

In short, the wig stopper of the present invention is a wig stopper comprising a bent, counter-bendable, component obtainable by processing a single elastic thin sheet to crook and imparting contrarotation performance thereto, and a number of hair-fastening components (2) in which the base end part (21) is provided on the longer direction (11) of the upper end of the bent, counter-bendable, component (1) and the tip end part (22) is extended to the longer direction (12) of the lower end of the bent, counter-bendable, component (1) and which are arranged in a comb-tooth-like state.

The above wig stopper is characterized in that a hollow part (13) is provided at the center of the bent, counter-bendable, component (1).

The above wig stopper is a wig stopper comprising a sheet-like flexible component (3) fitted thereto, which is characterized in that hair-fastening components (2) arranged in a comb-tooth-like state are exposed onto the sheet-like flexible component (3).

Furthermore, the above wig stopper is characterized in that a pressure-sensitive adhesive is adhered to one side of the sheet-like flexible component (3).

Besides, the wig stopper-fitting sheet of the present invention is a wig stopper-fitting sheet which is a sheet-like flexible component for fitting a wig stopper consisting of a bent, counter-bendable, component comprising an elastic thin sheet, being bent and having contrarotation performance imparted thereto, and a number of hair-fastening components arranged in one longer direction of the bent, counter-bendable, component in a comb-tooth-like state to the back of a wig base so that it can be removed freely, characterized in that a pressure-sensitive adhesive is adhered to one side thereof, and notches are provided on the sheet-like flexible component so that the hair-fastening components should be exposed onto the sheet-like flexible component when the sheet-like flexible component is put on the wig stopper.

BRIEF DESCRIPTION OF THE DRAWINGS

FIG. 1(*a*) is a plan view, FIG. 1 (*b*) is a front view, FIG. 1(*c*) is a perspective view taken from the upper part, and FIG. 1(*d*) is a front view after counter bending.

FIG. 2(*a*) is a plan view, and FIG. 2(*b*) is a perspective view illustrating the state of the fitting sheet being fitted to a stopper.

FIG. 3(*a*) is a plan view, and FIG. 3(*b*) is a perspective view illustrating the state of the fitting sheet being fitted to a stopper.

FIG. 4(*a*) is a plan view, and FIG. 4(*b*) is a perspective view illustrating the state of the fitting sheet being fitted to a stopper.

FIG. 5(*a*) is a plan view of the wig stopper, FIG. 5(*b*) is a plan view of the fitting sheet, and FIG. 5(*c*) is a perspective view illustrating the state of the fitting sheet being fitted to the stopper.

FIG. 7(*a*) illustrates the state before contrarotation, and FIG. 7(*b*) illustrates the state after contrarotation.

FIG. 8(*a*) is a plan view, and FIG. 8(*b*) is a front view.

DESCRIPTION OF THE PREFERRED EMBODIMENTS

Figure 1A:
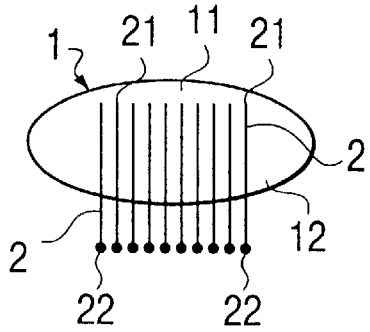
FIGS. 1(*a*)–1(*d*) show a wig stopper according to the present invention.
Figure 1B:
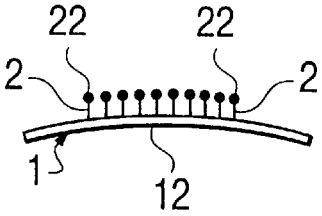
Figure 1C:
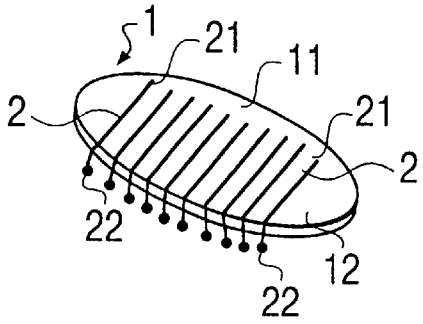
Figure 1D:
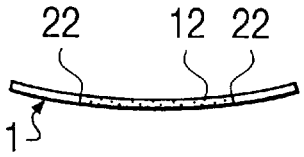

Hereafter, the present invention will be described with reference to the examples shown in the drawings.

Wig Stopper

FIG. 1 shows a wig stopper according to the present invention; FIG. 1(*a*) is a plan view, FIG. 1(*b*) is a front view, and FIG. 1(*c*) is a perspective view taken from the upper part.

FIG. 1(*d*) is a front view illustrating the state that the wig stopper is counter bent and hair-fastening components 2, arranged in a comb-tooth state are fastened to a bent, counter-bendable, component 1.

FIG. 1, the wig stopper of the present invention comprises the bent, counter-bendable, component 1, that may be obtained by processing a single elastic thin sheet to obtain a bent, yet counter-bendable, shape. Also, a plurality of hair-fastening components 2 are fastened to the bent, counter-bendable, component 1.

Non-limiting examples of an elastic thin sheet of the wig stopper of the present invention include a planar metal sheet and a plastic sheet. As for a metal sheet, for example, a stainless steel thin sheet with excellent spring properties, is preferred. In order to bend such a thin sheet, and to impart counter-bendable properties to obtain a bent and counter-bendable component 1, the thin sheet is subjected to extrusion pressure processing (heating processing in the case of a plastic sheet). However, such a component may be obtained by distorting a thin sheet by any other process which produces a bent sheet having a counter-bendable property.

Hence, while a stainless steel thin sheet was blanked into a U-shape, and both open ends thereof were drawn to the inner side, piled, and fixed with an eyelet in a conventional stopper, such processing is not needed in the present invention. More specifically, in accordance with the present invention a single thin sheet with no piling spot can be employed.

It is desirable from the viewpoint of increasing the counter bendability of the thin sheet, that the elastic thin sheet has an elasticity modulus from 0.4 kg to 2 kg (load at the time when both ends of the thin sheet are fixed and the center of the thin sheet is loaded to counter bend). However, it is not necessary to limit an elasticity modulus to the above range from the viewpoint as a stopper.

Figure 5A:
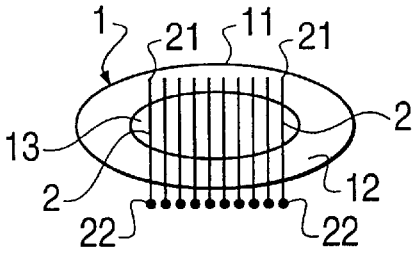
FIGS. 5(*a*)–5(*c*) show a wig stopper and a fitting sheet according to the present invention.
Figure 5B:
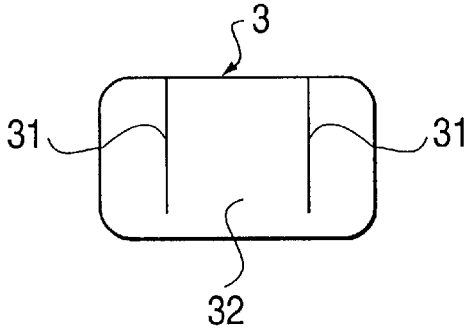
Figure 5C:
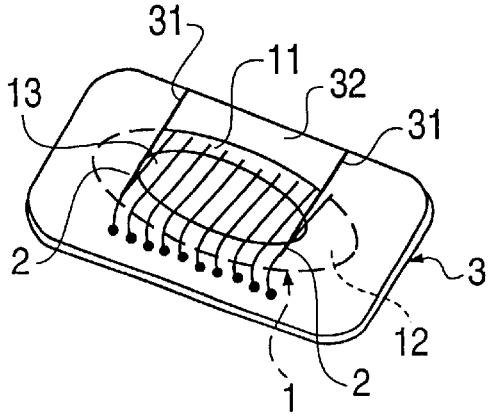

Besides, as shown in FIG. 5(*a*), the bent, counter-bendable, component 1 may have a configuration having a hollow part 13 at the center for the purpose of adjusting extrusion pressure required for counter-bendable and decreasing its weight. In this case, the hollow part 13 at the center is formed by blanking the corresponding spot of the sheet before subjecting the sheet to the extrusion pressure processing.

The hair-fastening components 2 of the present example have a base end part provided on a longitudinal side of the bent, counter-bendable, component 1, wherein the longitudinal sides are longer than the lateral sides of the bent, counter-bendable, component 1. The hair-fastening components 2 are obtained by forming metal elastic materials, with excellent spring properties into a linear or sheet-like form. Non-limiting examples include plastic, stainless steel and steel materials. It is desirable to provide a number of components 2 on the bent, counter-bendable, component 1. In addition, one continuous linear material may be processed into a U-shaped or V-shaped corrugated form and fixed to the bent, counter-bendable, component 1. However, with respect to increasing durability and hair scooping ability, it is desirable to provide a plurality of metal elastic linear materials on the bent, counter-bendable, component 1.

When the hair-fastening components 2 are formed of a metal elastic linear material, they are preferably moderately bent inward toward the bent, counter-bendable, component at the intermediate part between tip end part 22 and the base end part 21, so as to enable the tip end part to deeply enter, and scoop up, the hair of the head. Moreover, the tip end part 22 preferably has an enlarged spherical configuration in order to prevent damage to the head skin while wearing a wig having a wig stopper in accordance with the present invention.

The hair-fastening components 2 may be attached to the upper longitudinal side 11 of the base end part 21 of the bent, counter-bendable, component by means of welding or an adhesive. Another exemplary method of attaching hair-fastening components 2 to the base end part 2, includes forming the bent, counter-bendable, component 1 and the hair-fastening components 2 simultaneously, and integrally, by cutting a single metal elastic thin sheet.

A number of hair-fastening components 2 are arranged in a comb-tooth fashion so that they may fasten to the hair, and the tip end parts 22 extend to the longer direction of the lower end of the bent, counter-bendable, component. Exemplary comb-tooth embodiments of the hair-fastening components include forms that are linear, doglegged, or S-shaped. Moreover, in another embodiment, the hair-fastening components may be provided diagonally across the longitudinal direction of the bent, counter-bendable, component.

The tip end parts 22 of the hair-fastening components 2 preferably extend beyond the lower end 12 of the bent, counter-bendable, component 1, to easily scoop up hair. However, the end parts 22 do not particularly need to extend since hair is held and press-fixed between the hair-fastening components 2 and either the bent, counter-bendable, component 1 or a wig stopper-fitting sheet to be described later.

Similar to a conventional wig stopper, a flexible frictional component, for example a component made of rubber or soft resin, is fastened to the lower end 12 to which the metal linear material 2 is press-fastened during counter-bendable, thereby increasing the ability to hold hair therebetween. However, a wig stopper-fitting sheet, to be described later, can be employed more effectively.

Wing Stopper-Fitting Sheet

Figure 2A:
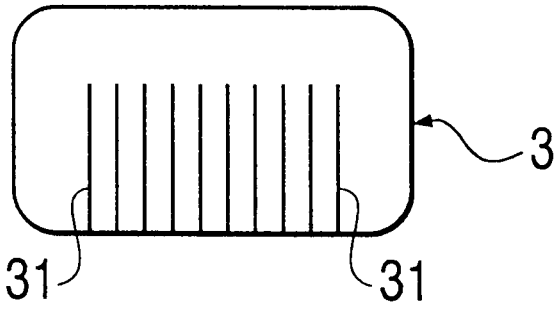
FIGS. 2(*a*) and 2(*b*) show a wig stopper-fitting sheet according to the present invention.
Figure 2B:
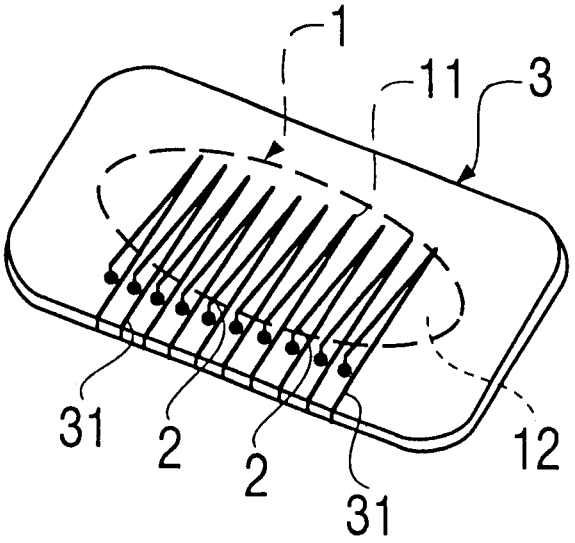

FIG. 2(*a*) is a plan view of a wig stopper-fitting sheet (hereafter may be referred to as a fitting sheet), and FIG. 2(*b*) is a perspective view illustrating the state of the fitting sheet being mounted on said wig stopper of the present invention.

The fitting sheet 3 is a component employed to accommodate a wig stopper, and to fix the wig stopper to the back of a wig base. Moreover, the fitting sheet increases the fixing force for holding hair; as it comprises a material having better frictional properties than the bent, counter-bendable, component. The fitting sheet covers the portion of the lower end of the bent, counter-bendable, component 1 to which the hair-fastening components 2 of the wig stopper are located.

Hence, the fitting sheet 3 preferably is a sheet-like flexible component capable of emulating the bent shape and counter bendable characteristics of the wig stopper. More preferably, the fitting sheet 3 may comprise a component having an excellent frictional force. Preferable materials for such a fitting sheet include urethane-based polymers.

An acrylic pressure-sensitive adhesive is adhered to the back of the fitting sheet to permit the fitting sheet to be freely fitted to, or removed from, the back of the wig base. As an alternative to an acrylic pressure sensitive adhesive, a pressure-sensitive adhesive may be used, which comprises a natural or synthetic rubber as a main agent and further comprises a petroleum resin, rosin, or a coumarone-indene resin as a tackifier.

On the fitting sheet 3 are provided notches so that the hair-fastening components 2 may be exposed through the sheet 3.

In the present Example, a number of linear notches according to the number of the metal linear hair-fastening components 2 are provided, and hence, each of a number of hair-fastening components 2 arranged in a comb-tooth fashion is exposed from the base part 21 through the fitting sheet, and the movement thereof is not restricted. Further sheet 3 can be fastened to, or removed from, the longitudinal side 12 of the component 1 according to the counter bendable movement of the bent, counter-bendable, component 1. Sheet 3 covers the stopper with the exception of the hair-fastening components 2 of the stopper.

Hence, the fitting sheet fixes the wig stopper to the back of the wig base and covers the longitudinal side 12 as a frictional component to heighten fastening properties in order to hold hair.

Figure 3A:
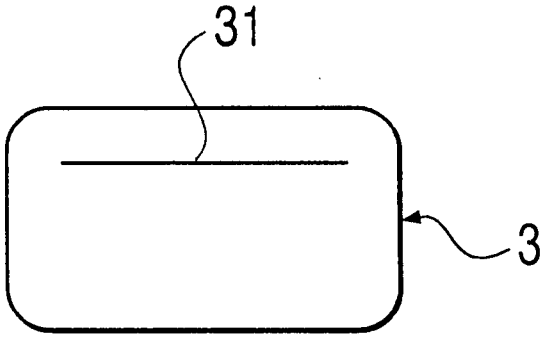
FIGS. 3(*a*) and 3(*b*) show a wig stopper-fitting sheet according to the present invention.
Figure 3B:
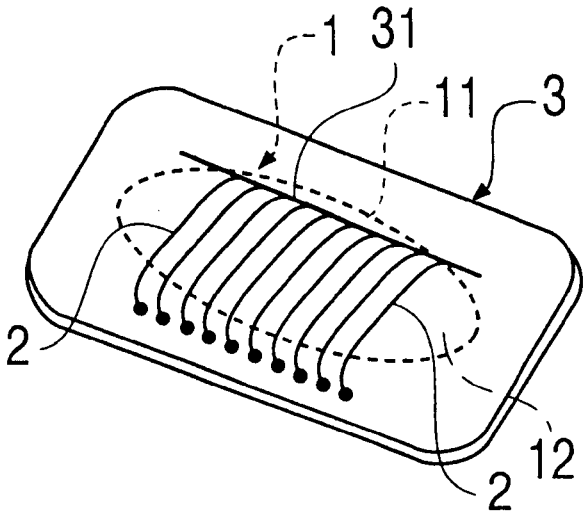
Figure 4A:
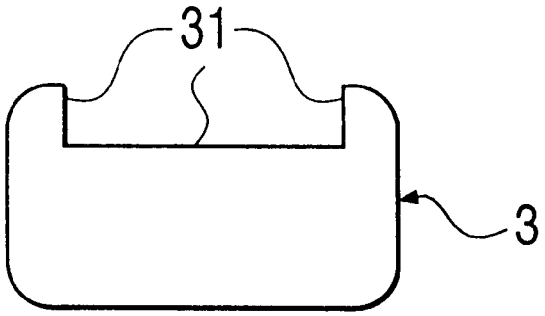
FIGS. 4(*a*) and 4(*b*) show a wig stopper-fitting sheet according to the present invention.
Figure 4B:
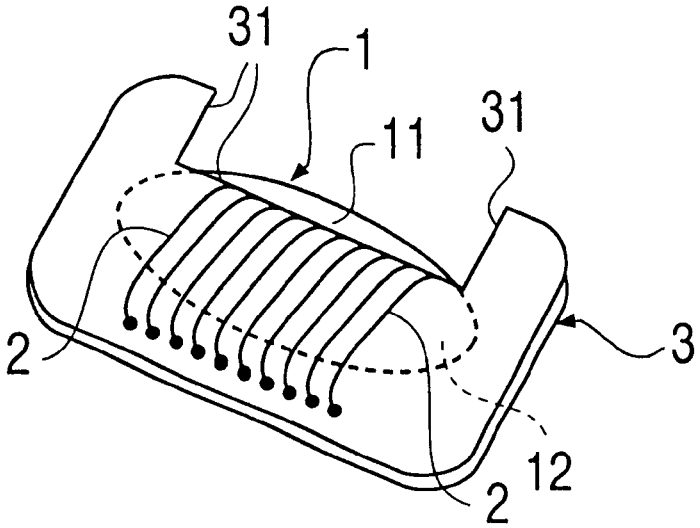

A notch 31 may be provided on the sheet 3 in various embodiments, for example, as shown in FIG. 3 and FIG. 4. In each of FIG. 3 and FIG. 4, FIG.(*a*) is a plan view of a stopper-fitting sheet, and FIG.(*b*) is a perspective view illustrating the state of the fitting sheet being fitted to the wig stopper of the present invention.

On the fitting sheet shown in FIG. 3(*a*), is provided a transversely linear notch 31, and as shown in FIG. 3(*b*), the base end part 21 of each hair-fastening component 2 is exposed from the notch 31.

A notch 31 is provided by cutting the upper end part of the fitting sheet shown in FIG. 4(*a*). As shown in FIG. 4(*b*), the upper part from the base end part 21 of each hair-fastening component 2 of the stopper 1, is exposed.

As described above, the notch 31 may be a linear notch as above, or a notch cut in a planar state.

Hereafter, another example will be described.

FIG. 5(*a*) is a plan view of a wig stopper comprising a bent counter-bendable component 1 having a hollow part 13 at the center thereof, and hair-fastening components 2 arranged in a comb-tooth fashion. FIG. 5(*b*) is a plan view of a fitting sheet. FIG. 5(*c*) is a perspective view illustrating the state of the fitting sheet as shown in FIG. 5(*b*) being fitted to the wig stopper shown in FIG. 5(*a*).

Since the hollow part 13 is provided, as shown in FIG. 5(*a*), the longer side portions 11 and 12 may be referred to as leg pieces.

Since two linear notches 31 are provided on the fitting sheet 3, the intermediate part 32 of the notches 31 becomes a free piece to be covered by the longitudinal side 12 of the lower end of the bent, counter-bendable, component 1 in the wig stopper. Further, the intermediate part 32 can be arranged between the lower parts of a number of metal linear hair-fastening components 2 arranged in a comb-tooth fashion and the longitudinal side 11 of the upper end. Thus, a number of hair-fastening components 2 are exposed onto the sheet 3 and can be fastened to, or removed from, the longitudinal side 12 of the lower end according to the bent state of the bent, counter-bendable, component 1.

Figure 6:
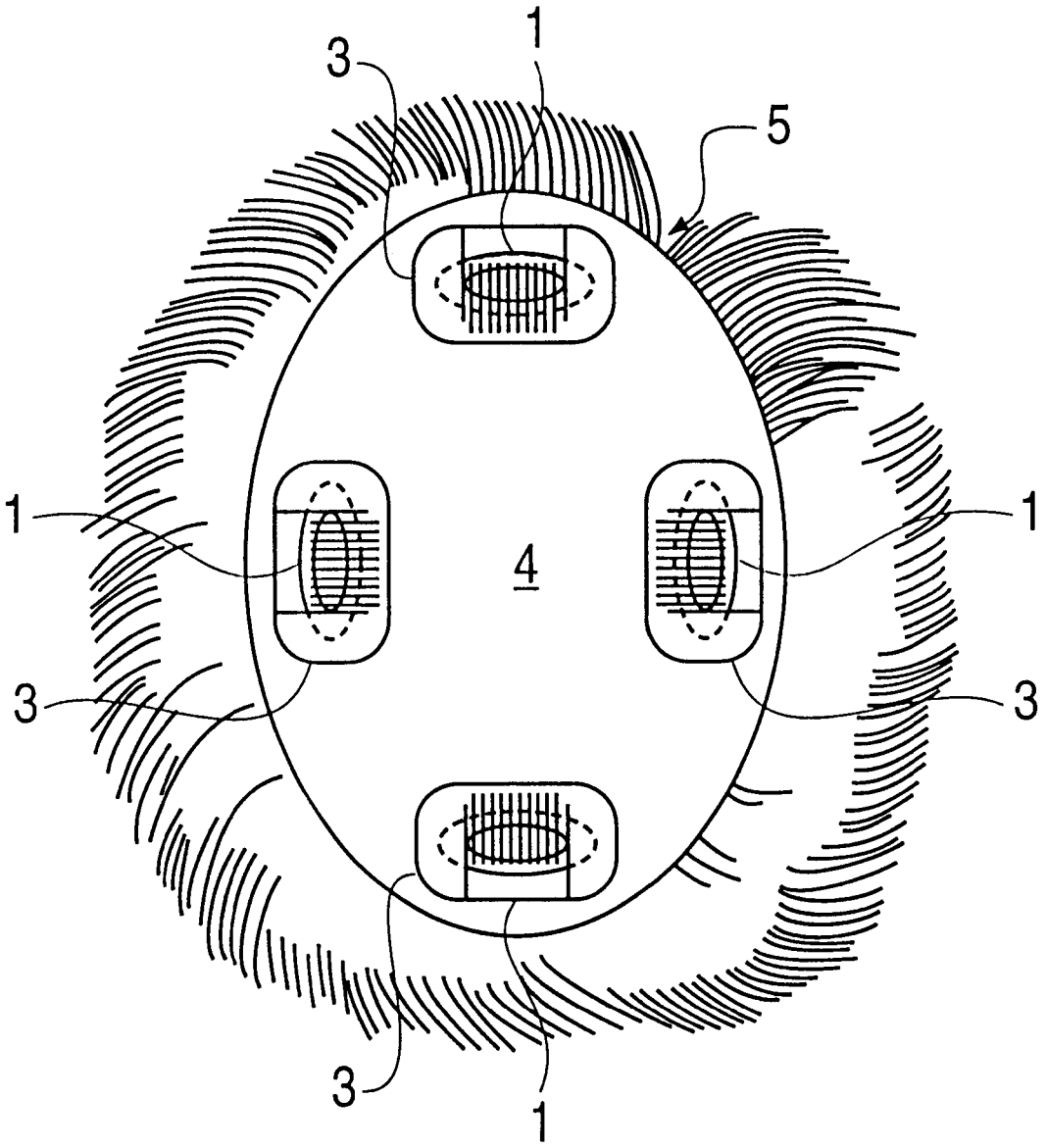
FIG. 6 is a plan view illustrating the state of a wig stopper according to the present invention being fitted to the back of a wig base.

Hence, while the fitting sheet can fix the wig stopper to the back of the wig base, it also functions as a frictional component, covering the longitudinal side 12, and can increase hair holding ability Exemplary Use of the Wig Stopper FIG. 6 is a plan view illustrating the state of the stopper being fitted to the back of the wig base.

Figure 7A:
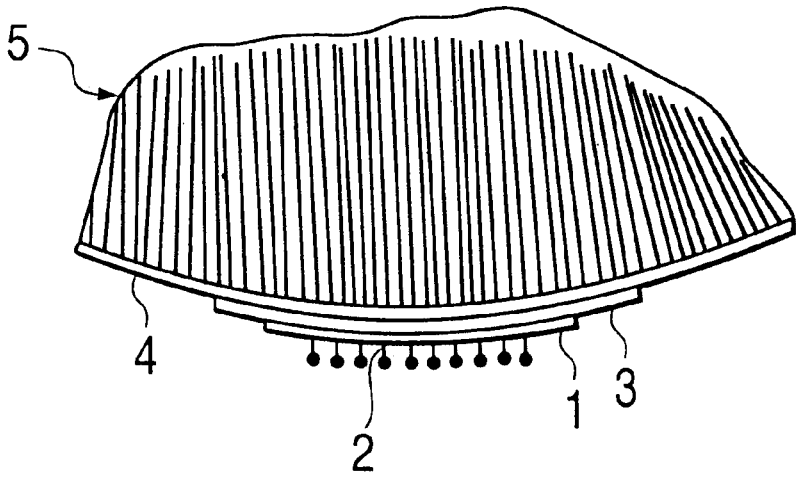
FIGS. 7(*a*) and 7(*b*) are sectional side views illustrating the operation state of a wig stopper according to the present invention.
Figure 7B:
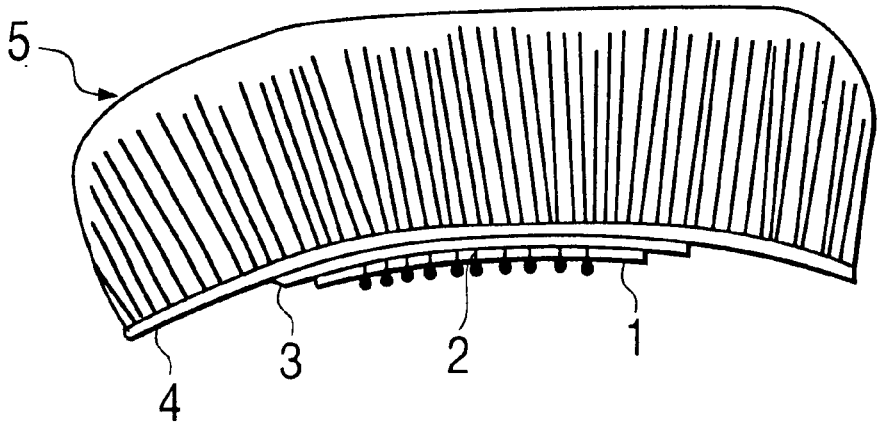
Figure 8A:
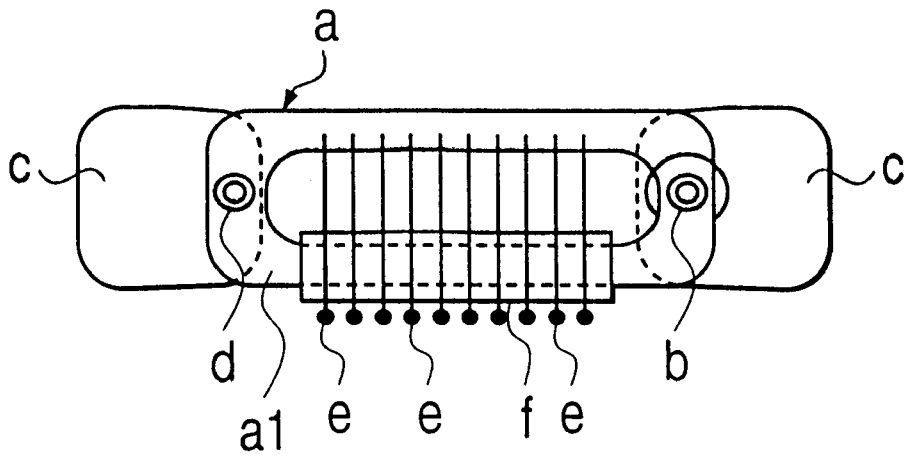
FIGS. 8(*a*) and 8(*b*) show a conventional wig stopper.
Figure 8B:
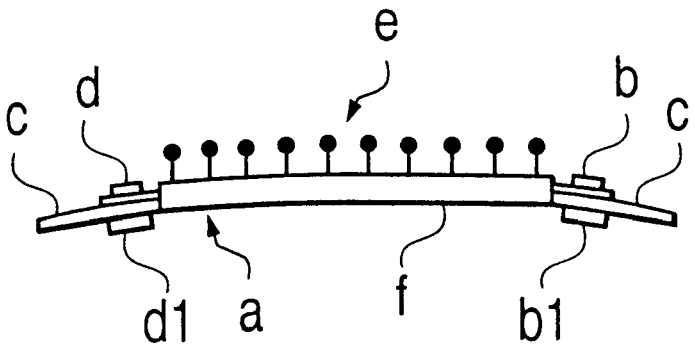

FIGS. 7(*a*) and (*b*) are sectional side illustrations showing the operation state of the stopper.

As shown in FIG. 6, the stopper is fixed to the surrounding rim part of the back of the base 4 of the wig 5 with hair planted on the surface thereof, by way of the fitting sheet 3.

As shown in FIG. 6, wherein the stopper is fitted to the surrounding rim part of the back of the wig base 4, since a pressure-sensitive adhesive is adhered to the back of the fitting sheet 3, the stopper can be fitted by sticking the fitting sheet 3 to an optional spot of the back of the wig base 4 instead of the surrounding rim part. One, or more, stoppers may be fitted depending on the size of the wig.

To wear a wig using stoppers in accordance with the present invention, a wig-wearing person would place the wig 5, with stoppers fitted thereto, on his head and press both ends of each stopper from above the wig 5. Consequently, the bent configuration of the bent, counter-bendable, component 1 counter bends from the state shown in FIG. 7(*a*) to the state shown in 7(*b*).

As a result, a number of hair-fastening components 2 arranged in a comb-tooth fashion and separated from the longitudinal side 12 (not shown) of the lower end of the bent, counter-bendable, component 1 are pressed to the fitting sheet 3 on the longitudinal side 11 of the lower end, thereby holding hair to grab the hair.

In the case of removing the wig inversely, the central part of the stopper is pressed from above the wig. Consequently, the bent, counter-bendable, component 1 returns to its original state and easily lets go of the hair.

The stopper is only fixed to the wig base with the pressure-sensitive adhesive on the back of the stopper-fitting sheet, so it can be easily released. Hence, a wig-wearing person himself can adjust the stopper by fastening it to a spot where his natural hair is sufficiently fixed.

The wig stopper and the wig stopper-fitting sheet of the present invention are as described above and have the following effects.

(1) The bent, counter-bendable, component 1 of the wig stopper is a single sheet obtainable by subjecting an elastic thin sheet to extrusion pressure processing. Contrary to a conventional stopper, the stopper of the present invention has no spot for stacking two metal sheets nor an eyelet for fixing them. As such, the present invention provides a very thin stopper that imparts excellent wearing comfort. In addition, since the stopper of the present invention has no eyelet, pain caused by tangling of a wig-wearing person's hair can be prevented.

Moreover, if the center of the stopper is hollow, the stopper can be made more lightweight and can be worn more comfortably.

(2) If the wig stopper-fitting sheet comprises a material having a frictional component, hair can be held and surely fixed at the spot where the hair-fastening components arranged in a comb-tooth fashion come into contact. Moreover, the sheet can be made thin as compared with a conventional sheet employing a tubular frictional component.

(3) Since the only part of the stopper not covered the fitting sheet is the part comprising the hair-fastening components, hair tangling can be surely prevented.

(4) Furthermore, in the case that the center of the bent, counter-bendable, component of the stopper is hollow, broad adhesion area including the corresponding part of the fitting sheet to the wig base can be ensured. Consequently, a sufficient fixing force can be obtained by a pressure-sensitive adhesive instead of a strong adhesive so that wearing and removal thereof are easy. As such a wig-wearing person can change and adjust the stopper-fitting spot easily by himself without any aid.

What is claimed is:

1. A wig stopper comprising:

a bent, counter-bendable, component comprising an elastic bent sheet, said elastic bent sheet being formed by extrusion pressure processing of a sheet of elastic material, thereby imparting a bent shape and a counter-bendable characteristic to said sheet of elastic material, said elastic bent sheet having a length and a width, the length being longer than the width, said elastic bent sheet having an upper portion extending along its length and a lower portion extending along its length; and a plurality of hair-fastening components arranged in a comb-tooth state, each said hair-fastening component comprising a base end and a tip end, wherein said base ends of said plurality of hair-fastening components are provided on said upper portion of said bent, counter-bendable, component, and wherein said tip ends of said plurality of hair-fastening components extend in the direction of the width of said bent, counter-bendable, component.

2. The wig stopper of claim 1, wherein said bent, counter-bendable, component further comprises a hollow portion at its center.

3. The wig stopper of claim 1, further comprising a flexible component having a front surface and a back surface, said front surface of said flexible component being attached to said bent, counter-bendable, component.

4. The wig stopper of claim 3, further comprising a pressure sensitive adhesive on said back surface of said flexible component.

5. The wig stopper of claim 1, wherein said elastic bent sheet has an elasticity modulus from 0.4 kg to 2 kg.

6. An apparatus comprising:

a flexible component having notches therein, said flexible component having a front surface and a back surface, said notches extend through said flexible component from said front surface to said back surface;

a bent, counter-bendable, component comprising and elastic bent sheet and a plurality of hair-fastening components, said elastic bent sheet having a counter-bendable characteristic, said elastic bent sheet having a length and a width, the length being longer than the width, said elastic bent sheet having an upper portion extending along its length and a lower portion extending along its length, said plurality of hair-fastening components being arranged in a comb-tooth state, each said hair-fastening component comprising a base end and a tip end, wherein said base ends of said plurality of hair-fastening components are provided on said upper portion of said bent, counter-bendable, component, and wherein said tip ends of said plurality of hair-fastening components extend in the direction of the width of said bent, counter-bendable, component; and a pressure sensitive adhesive provided on said back surface of said flexible component, wherein said bent, counter-bendable, component is situated with said flexible component by said notches of said flexible component, such that said plurality of hair-fastening components are not covered by said flexible component.

7. The apparatus of claim 6, wherein said elastic bent sheet has an elasticity modulus from 0.4 kg to 2 kg.

8. A wig stopper comprising:

a bent, counter-bendable, component comprising an elastic bent sheet, said elastic bent sheet having a counter-bendable characteristic, said bent, counter-bendable, component having no overlapping portions, said elastic bent sheet having a length and a width, the length being longer than the width, said elastic bent sheet having an upper portion extending along its length and a lower portion extending along its length; and a plurality of hair-fastening components arranged in a comb-tooth state, each said hair-fastening component comprising a base end and a tip end, wherein said base ends of said plurality of hair-fastening components are provided on said upper portion in the direction of the length of said bent, counter-bendable, component, wherein said tip ends of said plurality of hair-fastening components extend in the direction of the width of said bent, counter-bendable, component.

9. The wig stopper of claim 8, wherein said bent, counter-bendable, component further comprises a hollow portion at its center.

10. The wig stopper of claim 8, further comprising a flexible component having a front surface and a back surface, said front surface of said flexible component being attached to said bent, counter-bendable, component.

11. The wig stopper of claim 10, further comprising a pressure sensitive adhesive on said back surface of said flexible component.

12. The wig stopper of claim 8, wherein said elastic bent sheet has an elasticity modulus from 0.4 kg to 2 kg.

* * * * *